US007973254B2

(12) United States Patent
Yeh et al.

(10) Patent No.: US 7,973,254 B2
(45) Date of Patent: Jul. 5, 2011

(54) KEY STRUCTURE

(75) Inventors: Liang-Ta Yeh, Taipei County (TW); Chih-Chung Yen, Taoyuan County (TW); Chao-Lung Chang, Miaoli County (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 334 days.

(21) Appl. No.: 12/349,154

(22) Filed: Jan. 6, 2009

(65) Prior Publication Data

US 2009/0178909 A1 Jul. 16, 2009

(30) Foreign Application Priority Data

Jan. 11, 2008 (TW) ..... 97200676 U

(51) Int. Cl.
*H01H 13/70* (2006.01)

(52) U.S. Cl. ..... 200/344

(58) Field of Classification Search ..... 200/5 A, 200/517, 344, 345, 314, 317, 512; 400/490–496
See application file for complete search history.

(56) References Cited

U.S. PATENT DOCUMENTS 6,064,020 A * 5/2000 Yamada et al. ..... 200/344
6,958,458 B1 * 10/2005 Tsai ..... 200/344
7,138,587 B2 * 11/2006 Nishino et al. ..... 200/5 A

* cited by examiner

*Primary Examiner* — Edwin A. Leon
(74) *Attorney, Agent, or Firm* — Winston Hsu; Scott Margo

(57) ABSTRACT

The invention discloses a key structure including a keycap, a base plate, and a support member. The keycap includes a slide part; the base plate includes an engagement part; the support member includes a first end and a second end for engaging the keycap and the base plate. The first end slides on the slide part, and the second end is engaged to the engagement part. Therein, the second end thereon defines a first direction and a second direction perpendicular to the first direction. The first and second directions are substantially parallel to the base plate. The engagement part restrains the second end from sliding along the first direction. The second end includes two block parts. The block parts are deposited on two sides of the engagement part for restraining the second end from sliding along the second direction.

5 Claims, 5 Drawing Sheets

KEY STRUCTURE

CROSS-REFERENCE TO RELATED APPLICATIONS

This non-provisional application claims priority under 35 U.S.C. §119(a) on Patent Application No(s). 097200676 filed in Taiwan, R.O.C. on Jan. 11, 2008, the entire contents of which are hereby incorporated by reference.

BACKGROUND OF THE INVENTION

1. Field of the Invention

This invention relates to a key structure, and more particularly, to a key structure which is easy to be positioned.

2. Description of the Prior Art

In general, most of families in countries with developed information usually have a computer. People get information from the internet through a computer linked to the internet, or communicate with others on the internet by a message-delivering software of the computer. The most common input device in a computer is a keyboard, and the basic component of the keyboard is keys. Please refer to FIG. 1. FIG. 1 is a cross-section diagram illustrating a key structure according to a prior art. As shown in FIG. 1, the key structure of the prior art includes a key cap 10, a support member 12 and a base plate 14. The support member 12 includes engagement ends 120 and slide ends 122. The base plate 14 includes engagement parts 140 and slide parts 142. The engagement end 120 is engaged to the engagement part 140. The slide end 122 slides on the slide part 142. In general, the engagement end 120 includes a long arm and a short arm, substantially formed in L-shaped. The short arm is inserted to the engagement part 140. When the key structure 1 is knocked, the support member 12 may move along the short arm direction (e.g. the direction vertical to the sheet of the FIG. 1) due to vibration. It makes the key structure 1 easy to shake and the feedback feeling is not good.

Accordingly, a scope of the invention is to provide a key structure, for solving the problem which described above.

SUMMARY OF THE INVENTION

A scope of the invention is to provide a key structure which is easy to be positioned, for decreasing a displacement of the key structure due to vibrations.

According to an embodiment, the key structure of the invention includes a keycap, a base plate, and a support member. The keycap includes a first engagement part and a first slide part. The base plate includes a second engagement part and a second slide part. The support member is engaged to the keycap and the base plate respectively. The support member includes a first support and a second support. The first support is cross-connected to the second support. The first support includes a first end and a second end. The second support includes a third end and a fourth end. The first end is engaged to the first engagement part. The second end slides in the second slide part. The third end slides in the first slide part. The fourth end is engaged to the second engagement part.

According to the embodiment, the fourth end thereon defines a first direction and a second direction perpendicular to the first direction. The first direction and the second direction are substantially parallel to the base plate. The second engagement part restrains the fourth end from sliding along the first direction. The fourth end includes two block parts.

The block parts are deposited on two sides of the second engagement part for restraining the fourth end from sliding along the second direction.

Therefore, the key structure of the invention utilizing two block parts of the base plate to restrain the support member from sliding and then the key structure is uneasy to shake, the stability of the key structure increases, the wearing due to the mutual movement of the components decreases, and the feedback feeling in knocking is much better.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
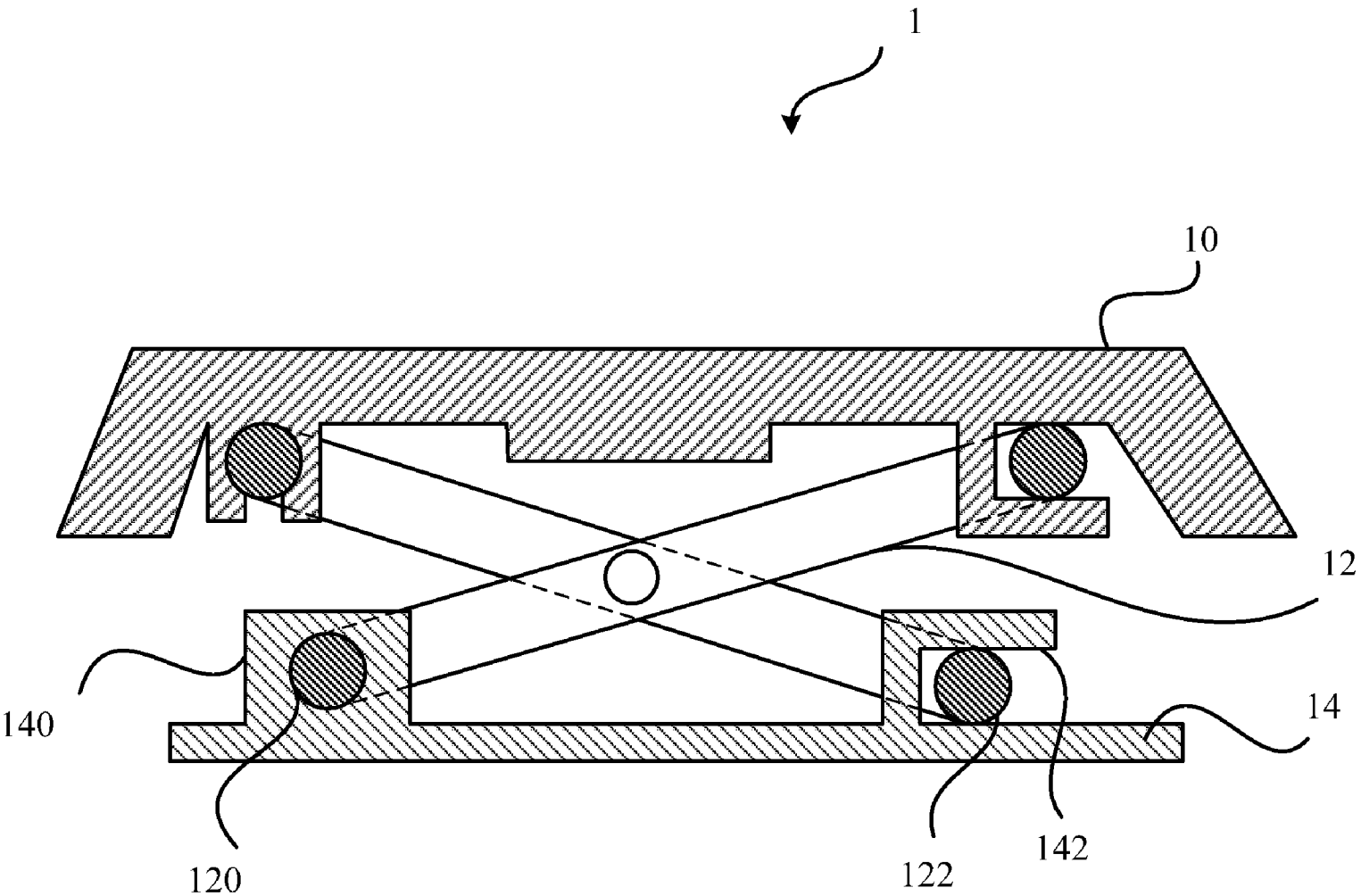
FIG. 1 (PRIOR ART)
FIG. 1 is a cross-section diagram illustrating a key structure according to a prior art.
Figure 2:
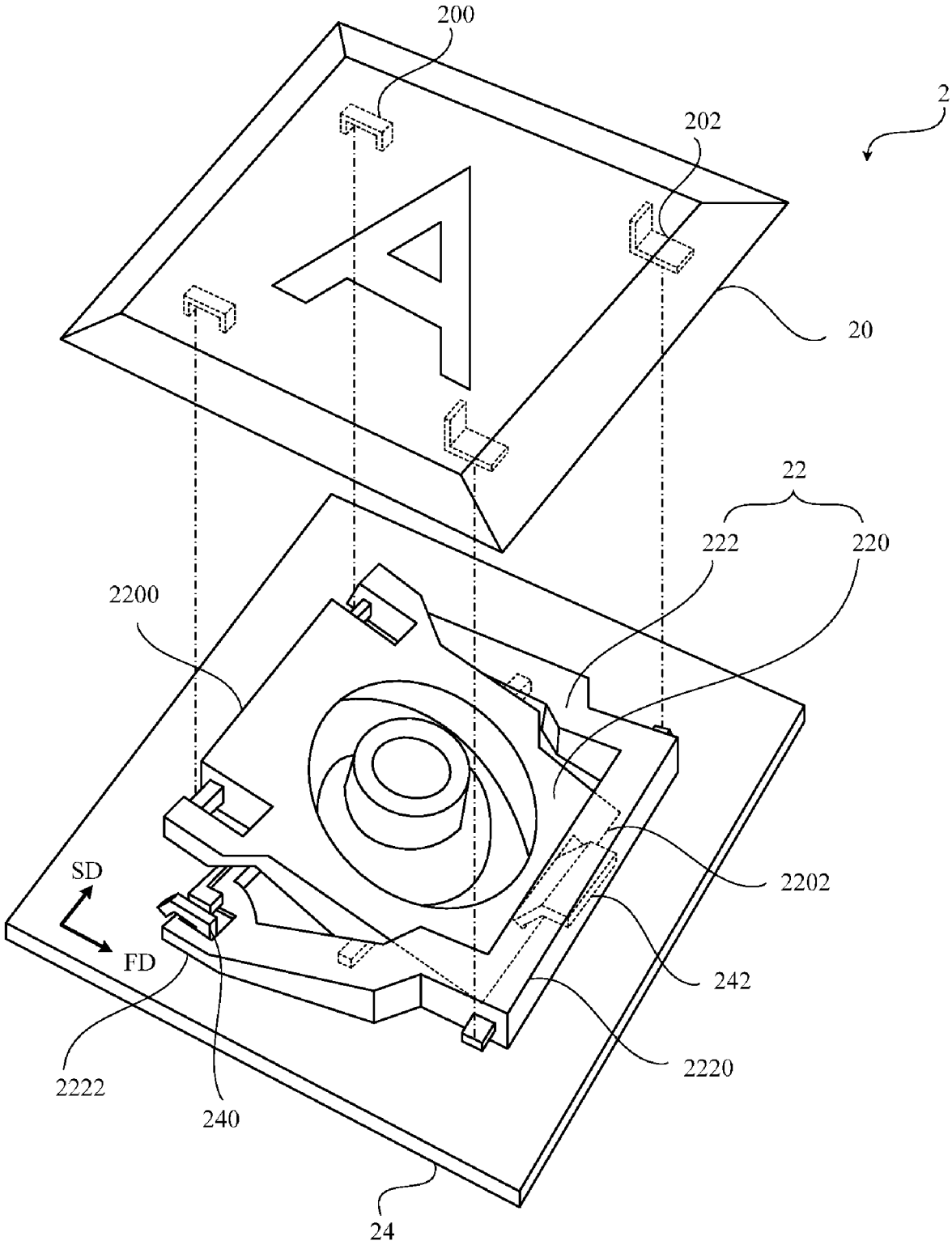
FIG. 2 is a schematic diagram illustrating a key structure 2 according to a first embodiment of the invention.

Please refer to FIG. 2. FIG. 2 is a schematic diagram illustrating a key structure 2 according to a first embodiment of the invention. As shown in FIG. 2, the key structure 2 includes a key cap 20, a base plate 24, and a support member 22. The key cap 20 includes two first engagement parts 200 and two first slide parts 202. The base plate 24 includes two second engagement parts 240 and a second slide part 242. The support member 22 is engaged to the key cap 20 and the base plate 24 respectively. The support member 22 includes a first support 220 and second support 222. The first support 220 is cross-engaged to the second support 222. As shown in FIG. 2, the first support 220 and the second support 222 are substantially formed in a rectangle. Two protrusion pins protrude at the middle of the outer fringe of the first support 220. Two holes are formed at the middle of the inner fringe of the second support 222. The holes correspond to the protrusion pins respectively and are engaged to the protrusion pins such that the first support 220 and the second support 222 are substantially engaged in X-shaped. Hereby, the first support 220 and the second support 222, like a pair of scissors, could make the key cap 20 engaged thereto capable of moving up and down relative to the base plate 24.

The first support 220 includes a first end 2200 and a second end 2202. The second support 222 includes a third end 2220 and a fourth end 2222. The first engagement part 200 is substantially formed in reverse U-shaped. The first end 2200 includes a pivot correspondingly. By the first engagement part 200 formed in reverse U-shaped clipping the pivot, the first end 2200 is engaged to the first engagement part 200. The second slide part 242 is substantially formed in C-shaped by extending an L-shaped plate form a surface of the base plate 24 to form a sliding space between the surface and the L-shaped plate. The second end 2202 is formed to be a slide correspondingly and slides on the sliding space. Thereby, the second end 2202 slides on the second side part 242.

Similar to the connection of the second end 2202 and the second slide part 242, the first slide part 202 is also substantially formed in C-shaped by extending an L-shaped plate from a bottom surface of the keycap 20 to form a sliding space between the bottom surface and the L-shaped plate. The third end 2220 of the second support 222 is formed to be two slides correspondingly sliding in the sliding spaces respectively formed by the first slide parts 202. Thus, the third end 2220 slides on the first slide part 202. The connections between fourth end 2222 of second support 222 and the second engagement 240 will be described in detail as followed.

Figure 3A:
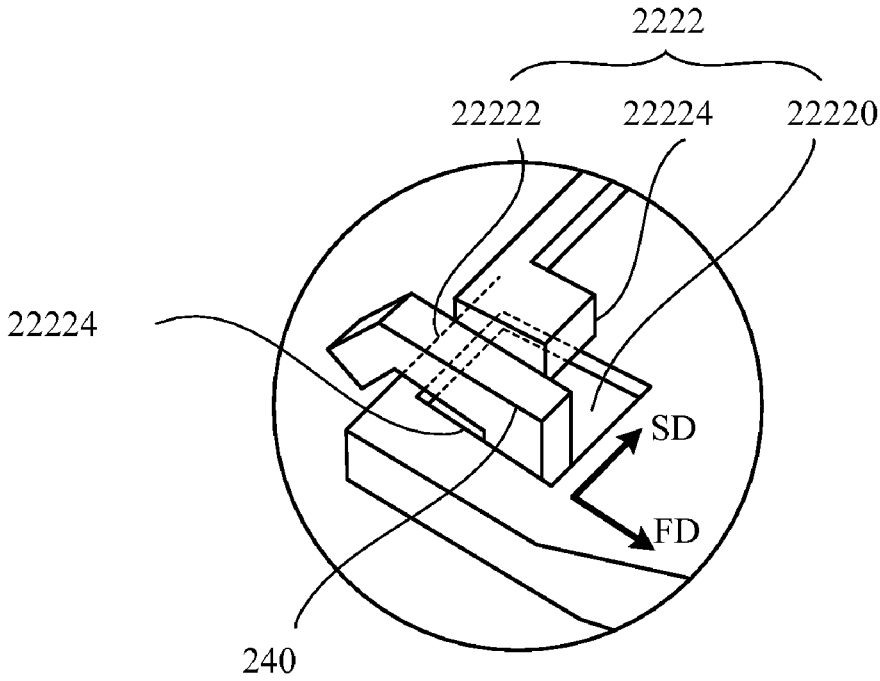
FIG. 3A is a schematic diagram illustrating the fourth end of the second support in FIG. 2.

Please refer to FIG. 3A. FIG. 3A is a schematic diagram illustrating the fourth end 2222 of the second support 222 in FIG. 2. As shown in FIG. 3A, the fourth end 2222 includes a hole 22220, a pivot 22222 (shown in dotted lines), and two block parts 22224. The block parts 22224 are respectively formed on two sides of the hole 22220. The pivot 22222 is disposed on another side of the hole 22220. A hook member is protruded from a surface of the base plate 24. The hook member is adapted to the pivot 22222 and forms a second engagement part 240 together with the surface. Thus, the hook member passes through the hole 22220 and hooks the pivot 22222 to achieve an purpose of engaging the second engagement part 240 and the fourth end 22222. The fourth end 22222 thereon defines a first direction FD and a second direction SD perpendicular to the first direction FD. The first direction FD and the second direction SD are substantially parallel to the base plate 24. As shown in the figure, the second direction SD is parallel to the axis of the pivot 22222, and the first direction FD is vertical to the pivot 22222. Besides, the block parts 22224 are disposed along the second direction SD at two sides of the second engagement part 240. Therefore, the second engagement part 240 could restrain the fourth end 2222 from sliding along the first direction FD; that is, the second support 222 rotates relative to the pivot 22222. Further, one of the block parts 22224 protrudes in the hole 22220 towards the second engagement part 240. In the design, the hook member of the second engagement part 240 easily passes through the hole 22220 of the fourth end 2222 to hook the pivot 22222, and after the hooking, the hook member of the second engagement part 240 can hook the pivot 22222 more stably because the block part 22224 protrudes inward, so as to present a more stable pivotal-engagement mechanism.

For example, to engage (e.g. be easy to assemble and position) the fourth end 2222 to the second engagement part 240 smoothly, the size of the hole 22220 needs to be bigger than the size of the hook member of the second engagement part 240. Therefore, if the pivot 22224 of the fourth end 2222 is too long (e.g. the distance of the hole 240 along the second direction SD is too large), the block part 22224 could reduce the available displacement along the second direction SD between the second engagement part 240 and the pivot 22222. When the key structure 2 (as shown in FIG. 2) is knocked, the displacement along the second direction SD can be controlled so that the key structure 2 is uneasy to shake. Therefore, most of the feedback force is transferred to the knocking object (ex. a finger of a user), and the wearing due to the mutual movement of the key structure 2 decreases.

Figure 3B:
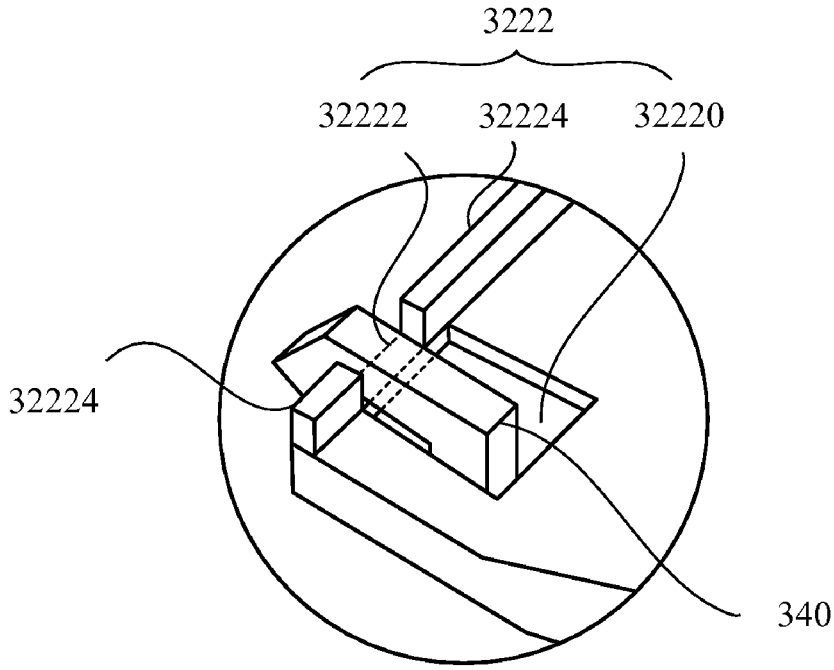
FIG. 3B is a schematic diagram illustrating a fourth end according to a second embodiment of the invention.

Please refer to FIG. 3B. FIG. 3B is a schematic diagram illustrating a fourth end 3222 according to a second embodiment of the invention. The main difference between FIG. 3B and FIG. 3A is that block parts 32224 are formed to protrude on two sides of the pivot 32222 respectively (as shown in dotted lines) and the block parts 32224 do not extend toward the hole 32220. The second embodiment is based on the assumption of the purpose of stop the fourth end 3222 moving along the second direction SD being still achieved although the area of the hole 32220 is not occupied. When the fourth end 3222 slides along the second direction SD and the second engagement part 340 does not touch the two sides of the hole 32220, a part of the second engagement part 340 engaged to the pivot 32222 could touch the block part 32224 firstly to decrease the displacement of fourth end 3222.

Figure 4A:
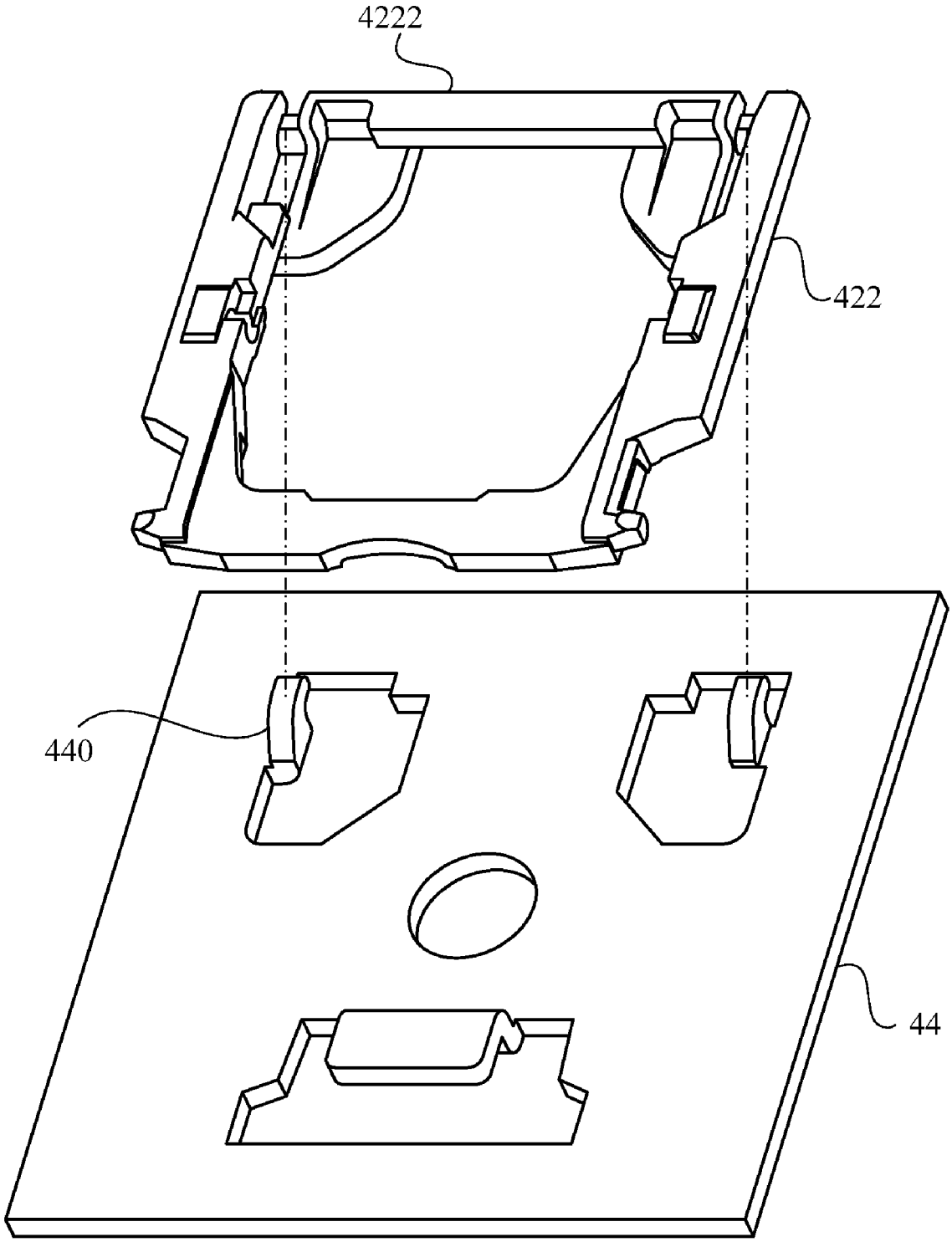
FIG. 4A is a schematic diagram illustrating a second support and a base plate according to a third embodiment of the invention.
Figure 4B:
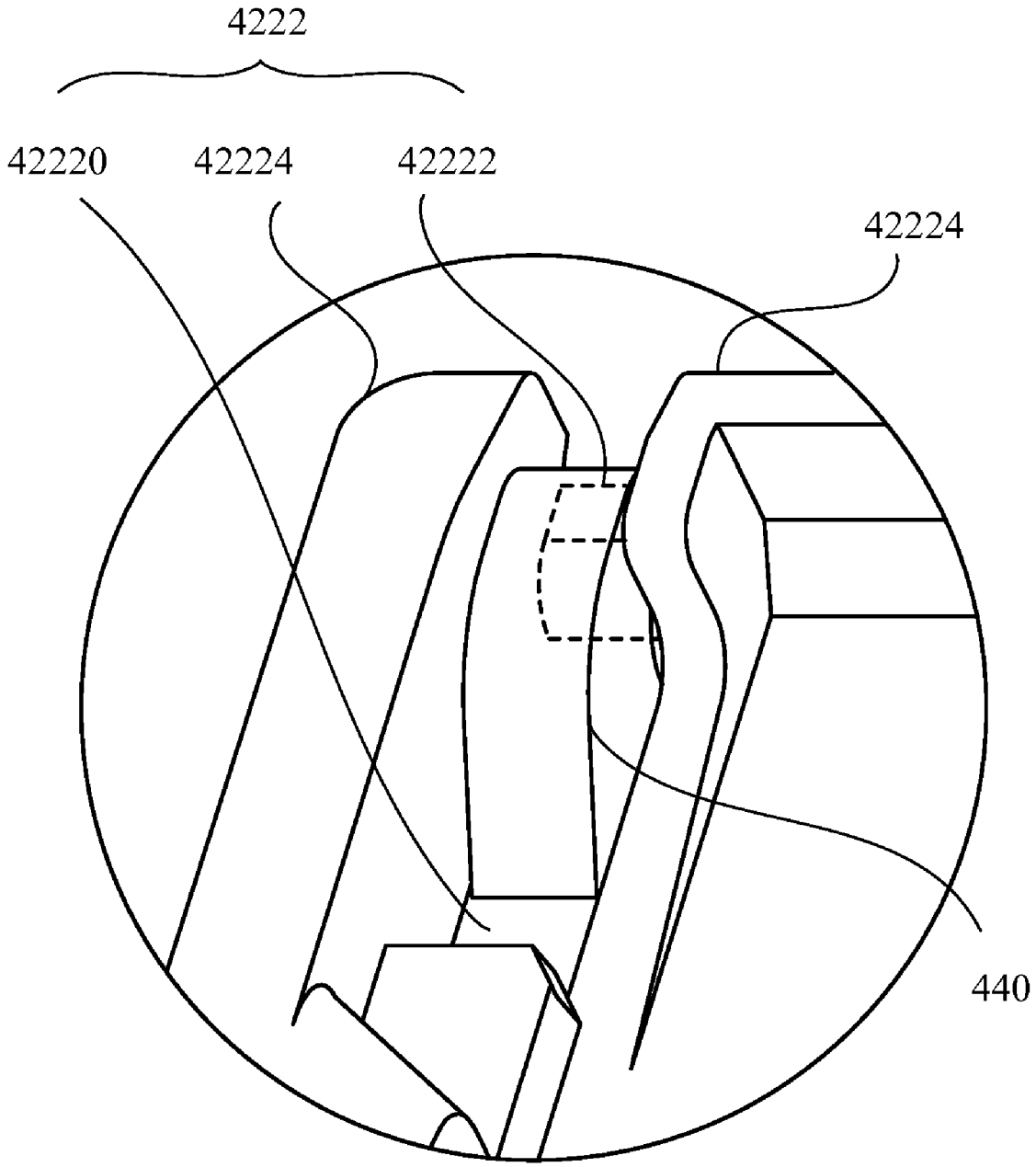
FIG. 4B is an assembly diagram illustrating a second engagement part of the base plate and a fourth end of the second support in FIG. 4A.

Please refer to the FIG. 4A and FIG. 4B. FIG. 4A is a schematic diagram illustrating a second support 422 and a base plate 44 according to a third embodiment of the invention. FIG. 4B is a assembly diagram illustrating a second engagement part 440 of the base plate 44 and a fourth end 4222 of the second support 422 in FIG. 4A. The main difference between FIG. 4B and FIG. 3B is that two block parts 42224 (as shown in dotted lines) are formed both on two sides of the pivot 42222 and on two sides of the hole 42220. Therefore, when the fourth end 4222 touches the second engagement part 440, the contact area between the block part 42224 and the second engagement part 440 increases to reduce the pressure thereon so that the block part 4224 and the second pivot part 440 are not easy to be damaged because of the pressured area being small (e.g. the pressure being large).

Compared with the prior art, the key structure of the invention utilizes two block parts of the base plate to restrain the support member from sliding. Further, the key structure of the invention is not easy to shake, the stability of the key structure increases, the wearing due to the mutual movement of the components decreases, and the feedback feeling in knocking is much better.

With the example and explanations above, the features and spirits of the invention will be hopefully well described. Those skilled in the art will readily observe that numerous modifications and alterations of the device may be made while retaining the features and spirit of the invention. Accordingly, the above disclosure should be construed as limited only by the metes and bounds of the appended claims.

What is claimed is:

1. A key structure comprising:

a keycap comprising a first engagement part and a first slide part;

a base plate comprising a second engagement part and a second slide part; and a support member for engaging the keycap and the base plate, the support member comprising a first support and a second support, the first support being cross-connected to the second support, the first support comprising a first end and a second end, the second support comprising a third end and a fourth end, the first end being engaged to the first engagement part, the second end sliding on the second slide part, the third end sliding on the first slide part, the fourth end being engaged to the second engagement part;

wherein the fourth end thereon defines a first direction and a second direction perpendicular to the first direction, the first direction and the second direction are substantially parallel to the base plate, the second engagement part restrains the fourth end from sliding along the first direction, the fourth end comprises two block parts, and the block parts are deposited on two sides of the second engagement part for laterally being blocked by the second engagement part in the second direction so as to restrain the fourth end from sliding along the second direction.

2. The key structure of claim 1, wherein the fourth end of the second support comprises a through hole and a pivot, and the second engagement part passes through the through hole and is pivotally engaged to the pivot.

3. The key structure of claim 2, wherein the block parts are formed on two sides of the through hole respectively.

4. The key structure of claim 3, wherein one of the block parts protrudes in the through hole toward the second engagement part.

5. The key structure of claim 2, wherein the block parts are formed on two ends of the pivot respectively.

* * * * *